US010964457B2

(12) United States Patent
Izawa et al.

(10) Patent No.: US 10,964,457 B2
(45) Date of Patent: Mar. 30, 2021

(54) CHIP RESISTOR

(71) Applicant: Panasonic Intellectual Property Management Co., Ltd., Osaka (JP)

(72) Inventors: Takahiko Izawa, Fukui (JP); Kazuhiro Kanda, Fukui (JP); Hiroshi Saito, Fukui (JP); Takashi Morino, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/611,494

(22) PCT Filed: Jul. 10, 2018

(86) PCT No.: PCT/JP2018/025967
§ 371 (c)(1),
(2) Date: Nov. 7, 2019

(87) PCT Pub. No.: WO2019/017237
PCT Pub. Date: Jan. 24, 2019

(65) Prior Publication Data

US 2020/0343025 A1 Oct. 29, 2020

(30) Foreign Application Priority Data

Jul. 19, 2017 (JP) ..... 2017-139632

(51) Int. Cl.
*H01C 1/016* (2006.01)
*H01C 7/00* (2006.01)
*H01C 17/065* (2006.01)

(52) U.S. Cl.
CPC ..... *H01C 1/016* (2013.01); *H01C 7/003* (2013.01); *H01C 17/065* (2013.01)

(58) Field of Classification Search
CPC ..... H01C 1/016; H01C 7/003; H01C 17/065
See application file for complete search history.

(56) References Cited

U.S. PATENT DOCUMENTS 7,782,173 B2 * 8/2010 Urano ..... H01C 17/006 338/307
2007/0296542 A1 * 12/2007 Kuriyama ..... H01C 7/003 338/258

(Continued)

FOREIGN PATENT DOCUMENTS

| | | |
|---|---|---|
| JP | 11-317301 | 11/1999 |
| JP | 2011-165752 | 8/2011 |
| JP | 2013-175523 | 9/2013 |

OTHER PUBLICATIONS

International Search Report of PCT application No. PCT/JP2018/025967 dated Oct. 2, 2018.

*Primary Examiner* — Kyung S Lee
(74) *Attorney, Agent, or Firm* — McDermott Will and Emery LLP

(57) ABSTRACT

The chip resistor according to the present disclosure includes insulating substrate, a pair of upper face electrodes provided on both ends of one face of insulating substrate, and resistor provided on the one face of insulating substrate and connected between the pair of upper face electrodes. The chip resistor includes a pair of end-face electrodes provided on both end faces of insulating substrate to be electrically connected to the pair of upper face electrodes, and plating layer formed on portions of the pair of upper face electrodes and faces of the pair of end-face electrodes. Insulating film formed of a resin is provided on another face opposite to the one face of insulating substrate. Insulating film has a thickness of more than or equal to 30 μm.

4 Claims, 3 Drawing Sheets

(56) References Cited

U.S. PATENT DOCUMENTS

| | | | | |
|---|---|---|---|---|
| 2008/0224818 | A1* | 9/2008 | Tanimura | H01C 17/281<br>338/309 |
| 2011/0057765 | A1* | 3/2011 | Ryu | H01C 17/02<br>338/252 |
| 2017/0271053 | A1* | 9/2017 | Yoneda | H01C 7/003 |
| 2018/0158578 | A1* | 6/2018 | Akahane | H01C 1/148 |

* cited by examiner

CHIP RESISTOR

CROSS-REFERENCE TO RELATED APPLICATIONS

This application is a U.S. national stage application of the PCT International Application No. PCT/JP2018/025967 filed on Jul. 10, 2018, which claims the benefit of foreign priority of Japanese patent application 2017-139632 filed on Jul. 19, 2017, the contents all of which are incorporated herein by reference.

FIELD OF THE INVENTION

The present disclosure relates to a small-sized chip resistor used in various electronic devices.

DESCRIPTION OF THE RELATED ART

As illustrated in FIG. 5, such conventional chip resistor 10 includes insulating substrate 1, a pair of upper face electrodes 2 provided on both ends of an upper face of insulating substrate 1, a pair of back face electrodes 2*a* provided on both ends of a back face of insulating substrate 1, and resistor 3 provided on the upper face of insulating substrate 1 and electrically connected between the pair of upper face electrodes 2. Chip resistor 10 further includes protection film 4 provided to cover at least resistor 3, a pair of end-face electrodes 5 provided on both end faces of insulating substrate 1 to be electrically connected to the respective pair of upper face electrodes 2, and plating layer 6 formed on portions of respective upper face electrodes 2 and faces of the pair of end-face electrodes 5.

Land 8 provided on mount board 7 and plating layer 6 are connected via solder layer 9 for mounting to mount chip resistor 10 on mount board 7.

Note that PTL 1 has been known as citation list information related to the invention of the application.

CITATION LIST

Patent Literature

PTL 1: Unexamined Japanese Patent Publication No. 2013-175523

SUMMARY OF THE INVENTION

In the above-mentioned chip resistor, thermal stress generates at a junction between solder layer 9 for mounting and chip resistor 10 by repeating conduction to chip resistor 10, which can cause a crack at the junction.

That is, a coefficient of thermal expansion of insulating substrate 1 and a coefficient of thermal expansion of mount board 7 are largely different from each other, so that stress due to temperature change is concentrated at solder layer 9 for mounting, readily causing thermal stress at the junction between solder layer 9 for mounting and chip resistor 10.

When the crack is generated at the junction, joining between chip resistor 10 and solder layer 9 for mounting becomes insufficient, which can disadvantageously eliminate original characteristics of the chip resistor.

The present disclosure solves the above-mentioned conventional problem, and aims to provide a chip resistor capable of suppressing generation of a crack at a junction between a solder layer for mounting and the chip resistor.

The chip resistor according to the present disclosure has the following structure.

That is, a chip resistor according to a first aspect includes an insulating substrate, a pair of upper face electrodes, a resistor, a pair of end-face electrodes, a plating layer, and an insulating film. The pair of upper face electrodes is provided on both ends of one face of the insulating substrate. The resistor is provided on the one face of the insulating substrate and provided between the pair of upper face electrodes to be electrically connected to the pair of upper face electrodes. The pair of the end-face electrodes is provided on both end faces of the insulating substrate to be electrically connected to the pair of upper face electrodes. The plating layer is provided on portions of the pair of upper face electrodes and faces of the pair of end-face electrodes. The insulating film is made of a resin, and is provided on another face opposite to the one face of the insulating substrate.

A chip resistor according to a second aspect is provided with a pair of back face electrodes on both ends of the other face of the insulating substrate, and the insulating film is disposed between the insulating substrate and the pair of back face electrodes, in the first aspect.

A chip resistor according to a third aspect has the insulating film having a thickness of less than or equal to three tenths of a thickness of the insulating substrate, in the first aspect.

A chip resistor according to a fourth aspect has the insulating film having a thickness of more than or equal to 30 μm, in the first aspect.

A chip resistor according to a fifth aspect has the insulating film having a length of more than or equal to one quarter of a whole length of the insulating substrate, in the first aspect.

The chip resistor according to the present disclosure is provided with the insulating film made of a resin on the other face of the insulating substrate, and the thickness of the insulating film is made to be more than or equal to 30 μm. Accordingly, the insulating film having flexibility is disposed between the insulating substrate and the solder layer for mounting to have a thick thickness. This makes it possible to absorb thermal stress generated at a junction between the solder layer for mounting and the chip resistor. This makes it possible to suppress that a crack is generated at the junction between the solder layer for mounting and the chip resistor.

DETAILED DESCRIPTION OF THE PREFERRED EMBODIMENTS

Hereinafter, a chip resistor according to an exemplary embodiment of the present disclosure will be described with reference to drawings.

Figure 1:
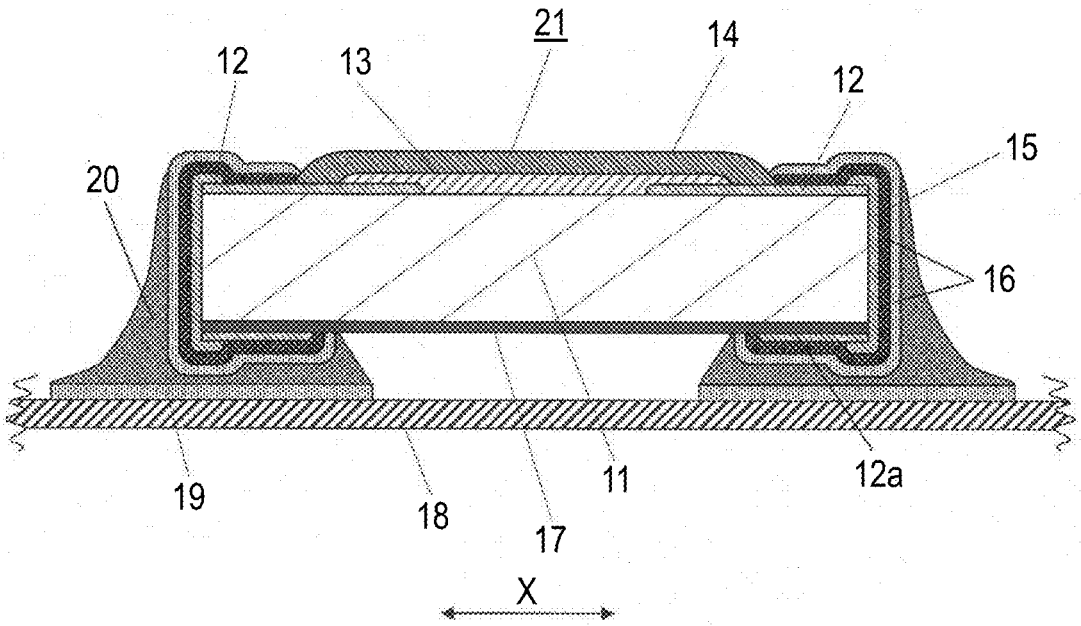
FIG. 1 is a cross-sectional view of a chip resistor according to an exemplary embodiment of the present disclosure.

FIG. 1 is a cross-sectional view of the chip resistor according to the exemplary embodiment of the present disclosure.

Chip resistor 21 according to the exemplary embodiment of the present disclosure has a structure as illustrated in FIG. 1. Chip resistor 21 includes insulating substrate 11, a pair of upper face electrodes 12, a pair of back face electrodes 12*a*, resistor 13, protection film 14, a pair of end-face electrodes 15, plating layer 16, and insulating film 17. The pair of upper face electrodes 12 is provided on both ends of one face (upper face) of insulating substrate 11. The pair of back face electrodes 12*a* is provided on both ends of another face (back face) opposing the one face of insulating substrate 11. Resistor 13 is provided on the upper surface of insulating substrate 11, and connected between the pair of upper face electrodes 12. Protection film 14 is provided to cover at least resistor 13. The pair of the end-face electrodes 15 is provided on both end faces of insulating substrate 11 so as to be electrically connected to the pair of upper face electrodes 12. Plating layer 16 is provided on portions of the pair of upper face electrodes 12 and faces of the pair of end-face electrodes 15. Insulating film 17 is made of a resin, and provided on a whole back face of insulating substrate 11.

In the above-mentioned structure, insulating substrate 11 is made of alumina including $Al_2O_3$ by 96%, and has a rectangular shape (rectangle in top view).

The pair of upper face electrodes 12 is provided on both ends of the upper face of insulating substrate 11, and formed by printing and burning a thick film material formed of copper. Note that a resurfaced upper face electrode (not shown) may be provided on an upper face of each of the pair of upper face electrodes 12. As illustrated in FIG. 1, a pair of back face electrodes 12*a* may be provided on both ends of the back face of insulating substrate 11.

Resistor 13 is formed by printing a thick film material formed of copper-nickel, silver palladium, or ruthenium oxide between the pair of the upper face electrodes 12 on the upper face of insulating substrate 11 and baking the thick film, or forming a thin film conductor using thin film process such as spattering of copper-nickel on a substantially whole face of insulating substrate 11 and removing a needless portion of the thin film conductor using a photolithography process.

Note that, a trimming groove (hereinafter, not shown) for adjusting a resistance value may be provided on resistor 13, and resistor 13 may have a meandering shape.

Protection film 14 is provided to cover portions of the pair of upper face electrodes 12, and resistor 13.

The pair of end-face electrodes 15 is provided on both end faces of insulating substrate 11, and formed by printing a material formed of Ag and a resin to be electrically connected with respective upper faces of the pair of upper face electrodes 12 exposed from protection film 14. The metallic material may be formed by sputtering. When the pair of back face electrodes 12*a* is formed, the pair of end-face electrodes 15 is connected to the pair of back face electrodes 12*a*.

Plating layer 16 formed of a Ni plating layer and a Sn plating layer is provided on faces of the pair of end-face electrodes 15. Plating layer 16 is in contact with protection film 14. Note that a Cu plating layer may be formed on a lower side of the Ni plating layer.

Insulating film 17 is made of a resin, and provided on a whole face in a longitudinal direction of the back face of insulating substrate 11. Herein, the longitudinal direction denotes a direction (X direction) parallel to a direction of current flowing between the pair of upper face electrodes 12.

Insulating film 17 is formed by printing a resin on a lower face (back face) opposite to the upper face of insulating substrate 11 and then drying and curing the resin. Insulating film 17 cured has a thickness of 30 μm to 80 μm.

Any of an epoxy resin, a phenol resin, a silicon resin, and a polyimide resin can be used for the resin forming insulating film 17.

When the pair of back face electrodes 12*a* is formed, the pair of back face electrodes 12*a* is provided on a lower face of insulating film 17, so that at least a portion of insulating film 17 is positioned between insulating substrate 11 and the pair of back face electrodes 12*a*.

Next, a mounting structure of above-mentioned chip resistor 21 will be described.

Chip resistor 21 is mounted on mount board 18 by connecting land 19 provided on mount board 18 and plating layer 16 via solder layer 20 for mounting (solder filet) as illustrated in FIG. 1.

Mount board 18 is made of glass epoxy, and land 19 is formed by plating mount board 18 with copper. Solder layer 20 for mounting is provided to connect the chip resistor 21 to land 19 of mount board 18, made of a material such as tin, and connected to the pair of plating layer 16 positioned on the both end faces and the lower face of insulating substrate 11.

Figure 2:
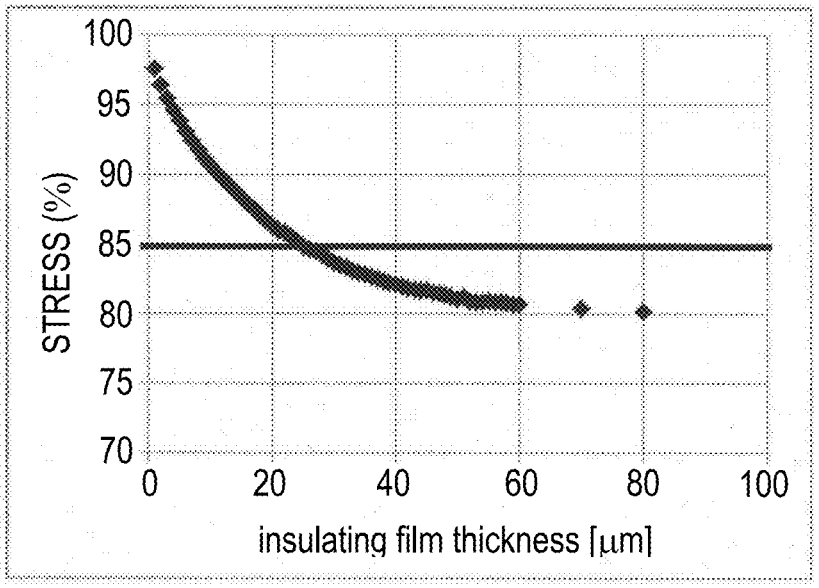
FIG. 2 is a diagram illustrating a relationship between a thickness of an insulating film and stress in the chip resistor.

Herein, a relationship between a thickness of insulating film 17 and stress is illustrated in FIG. 2.

Note that the stress is a result of measuring thermal stress generated at a junction between solder layer 20 for mounting and chip resistor 21 (near both ends of the back face of insulating substrate 11), and shows a rate that is 1 in a case where a film thickness of insulating film 17 is zero (the insulating film is absent).

As is apparent from FIG. 2, when the thickness of insulating film 17 is more than or equal to 30 μm, the stress becomes less than or equal to 85% as compared with a case where insulating film 17 is absent, thereby enabling to reduce possibility that a crack is generated at the junction between solder layer 20 for mounting and chip resistor 21.

As is understood from FIG. 2, when the thickness of insulating film 17 is more than or equal to 30 μm, the stress becomes substantially constant at over 80%, so that a case where the stress is less than or equal to 85% is determined as good.

An upper limit of the thickness of insulating film 17 may be determined in consideration of a request of a whole thickness of chip resistor 21 from users and workability, and determined to be, for example, 80 μm, but does not exceed a thickness of insulating substrate 11.

Although heat generated by resistor 13 is made to be less likely to be radiated by insulating film 17, specifically when the thickness of insulating substrate 11 is thin, heat capacity is small to make heat be less likely to be radiated to make a temperature of whole chip resistor 21 very high. This disadvantageously increases thermal stress generated at the junction with solder layer 20 for mounting.

Note that, the thickness of the chip resistor having a size of 0201 is generally about 100 μm, and the thickness of insulating substrate 11 becomes less than or equal to 100 μm with progress of miniaturization in the future. In a case where the thickness of insulating substrate 11 is less than or equal to 100 μm, heat generated at resistor 13 is not radiated without making the thickness of insulating film 17 be less than or equal to 30 μm to make thermal stress large and fail to keep rated power.

That is, the thickness of insulating film 17 needs to be less than or equal to three tenths of the thickness of insulating substrate 11.

Figure 3:
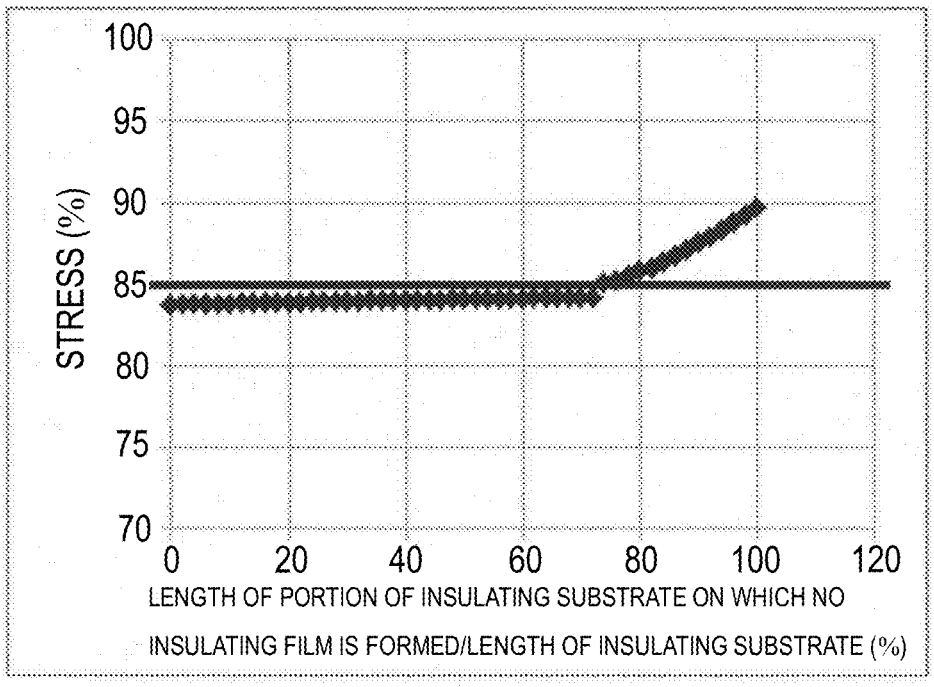
FIG. 3 is a diagram illustrating a relationship between a length of a portion of the insulating substrate on which no insulating film is formed with respect to a length of an insulating substrate and stress in the chip resistor.

FIG. 3 is a diagram illustrating a relationship between a length of a portion of insulating substrate 11 on which no insulating film 17 is formed with respect to a length of insulating substrate 11 and stress.

Like in FIG. 2, the stress shows a rate that is 1 in a case where insulating film 17 is absent, and the thickness of insulating film 17 is fixed at 30 μm, and a length of insulating film 17 is changed.

Figure 4:
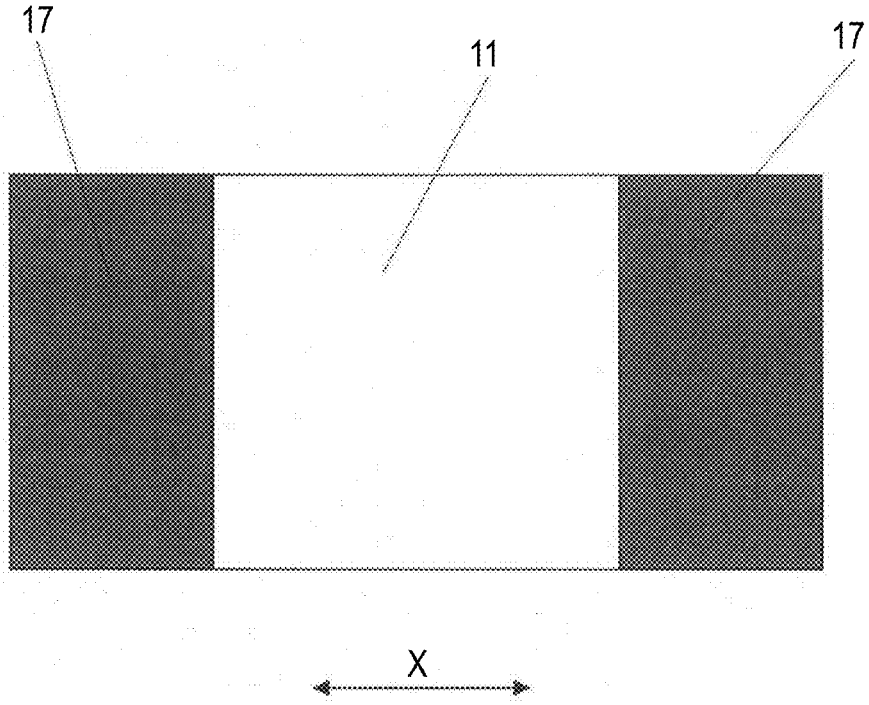
FIG. 4 is another face diagram of a main portion of the chip resistor.
Figure 5:
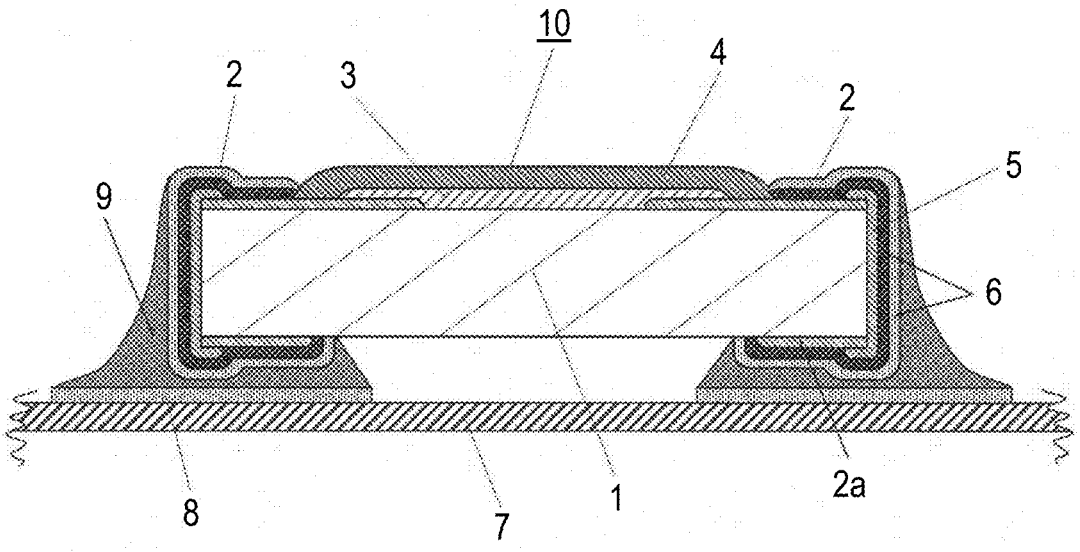
FIG. 5 is a cross-sectional view of a conventional chip resistor.

In this context, as illustrated in FIG. 4, portions of insulating film 17 positioned at both ends of the back face of insulating substrate 11 is surely left to change the length of insulating film 17 to gradually eliminate a center portion of insulating film 17 to measure the stress. FIG. 4 is a diagram viewed from a back face (another face) side, and the pair of back face electrodes 12*a*, the pair of end-face electrodes 15, and plating layer 16 are omitted.

Furthermore, a length of insulating film 17 is the same as the length of insulating substrate 11 in a case where a horizontal axis is 0%, and the length of insulating film 17 is zero (no insulating film 17 is formed) in a case where the horizontal axis is 100%. The length in this context denotes a length in a direction (X direction) parallel to a direction in which current flows between the pair of upper face electrodes 12.

As is apparent from FIG. 3, stress becomes less than or equal to 85% when a length of a portion of insulating substrate 11 that is not covered with insulating film 17 is made to be less than or equal to three quarters of the length insulating substrate 11, that is, when the length of insulating film 17 is made to be more than or equal to one quarter of the length of insulating substrate 11.

Note that the length may be made to be 0% (the length of insulating film 17 is same as the length of insulating substrate 11). The length of insulating film 17 is preferably at least made longer than the length of the pair of back face electrodes 12*a*.

As described above, in the exemplary embodiment of the present disclosure, insulating film 17 made of a resin is provided on the back face of insulating substrate 11, and the thickness of insulating film 17 is made to be more than or equal to 30 μm. Accordingly, insulating film 17 having flexibility is disposed between insulating substrate 11 and solder layer 20 for mounting to have a thick thickness. This makes it possible to absorb thermal stress generated at the junction between solder layer 20 for mounting and chip resistor 21. This yields an effect that generation of a crack at the junction between the solder layer for mounting and the chip resistor can be suppressed.

That is, even when conduction to chip resistor 21 is repeated, stress due to temperature change concentrated in solder layer 20 for mounting due to difference between a coefficient of thermal expansion of insulating substrate 11 and a coefficient of thermal expansion of mount board 18 is absorbed by insulating film 17 formed of a flexible resin existing between the back face of insulating substrate 11 and solder layer 20 for mounting.

The thickness of insulating film 17 is made to be more than or equal to 30 μm, thereby making it possible to efficiently reduce thermal stress generated at the junction between solder layer 20 for mounting and chip resistor 21. Not only forming insulating film 17 but also regulating its thickness makes it possible to suppress generation of a crack at the junction between solder layer 20 for mounting and chip resistor 21.

Generation of the crack at the junction can be suppressed, which strengthens the junction between chip resistor 21 and solder layer 20 for mounting, thereby making it possible to exert original characteristics of chip resistor 21.

The chip resistor according to the present disclosure has an effect that generation of a crack at a junction between a solder layer for mounting and the chip resistor can be suppressed, and is specifically useful in a small-sized chip resistor or the like used in various electronic devices.

The invention claimed is:

1. A chip resistor comprising:

an insulating substrate;

a pair of upper face electrodes provided on both ends of one face of the insulating substrate;

a resistor provided on the one face of the insulating substrate, the resistor being provided between the pair of upper face electrodes to be electrically connected to the pair of upper face electrodes;

a pair of end-face electrodes provided on both end faces of the insulating substrate to be electrically connected to the pair of upper face electrodes;

a plating layer disposed on portions of the pair of upper face electrodes and faces of the pair of end-face electrodes a pair of insulating films are comprised of a resin and provided on an other face of the insulating substrate, the other face being opposite to the one face of the insulating substrate, a pair of back face electrodes provided at both ends of the other face of the insulating substrate; wherein one of the pair of insulating films is disposed between the insulating substrate and one of the pair of back face electrodes, a length of the one of the pair of insulating film is made longer than a length of the one of the pair of back face electrodes, the other of the pair of insulating films is disposed between the insulating substrate and the other of the pair of back face electrodes, a length of the other of the pair of insulating film is made longer than a length of the other of the pair of back face electrodes, and the other face of insulating substrate is exposed between the one and the other of the pair of insulating films.

2. The chip resistor according to claim 1, wherein both of the pairs of the insulating films have a thickness of less than or equal to three tenths of a thickness of the insulating substrate.

3. The chip resistor according to claim 1, wherein both of the pairs of the insulating films have a thickness of more than or equal to 30 μm.

4. The chip resistor according to claim 1, wherein both of the pairs of the insulating films have a length of more than or equal to one quarter of a whole length of the insulating substrate.

* * * * *